US005708945A

United States Patent [19]

Kondo

[11] Patent Number: 5,708,945

[45] Date of Patent: Jan. 13, 1998

[54] TONER IMAGE TRANSFER PROVIDED WITH A TRANSFER PAPER SEPARATING DEVICE AND GUIDE

[75] Inventor: Akihiro Kondo, Osaka, Japan

[73] Assignee: Mita Industrial Co., Ltd., Osaka-fu, Japan

[21] Appl. No.: 607,411

[22] Filed: Feb. 28, 1996

[30] Foreign Application Priority Data

Mar. 3, 1995 [JP] Japan ..... 7-044435

[51] Int. Cl.[6] ..... G03G 15/16

[52] U.S. Cl. ..... 399/316

[58] Field of Search ..... 355/271, 274, 355/221; 250/324, 325; 399/311, 316

[56] References Cited

U.S. PATENT DOCUMENTS

| | | | |
|---|---|---|---|
| 4,739,363 | 4/1988 | Hoshika et al. | 355/274 |
| 4,906,841 | 3/1990 | Taniguchi | 250/324 |
| 5,552,873 | 9/1996 | Hirao et al. | 355/274 |

FOREIGN PATENT DOCUMENTS

| | | | |
|---|---|---|---|
| 62-123483 | 6/1987 | Japan | 355/274 |
| 01237678 | 9/1989 | Japan | 355/274 |
| 03260681 | 11/1991 | Japan | 355/274 |
| 04288573 | 10/1992 | Japan | 355/274 |

*Primary Examiner*—Robert Beatty

*Attorney, Agent, or Firm*—Jordan and Hamburg

[57] ABSTRACT

A toner image transfer for use in an image forming apparatus provided with a rotatable photosensitive member, the toner image transfer includes: a charging wire; a shield casing for shielding the charging wire, the shield casing including a first wall extending in parallel with the charging wire and a second wall extending in parallel with the first wall and positioned downstream of the first wall with respect to the rotation of the photosensitive member, the first and second walls each having a free end defining an opening facing the photosensitive member, a line connecting the respective free ends of the first and second walls intersecting a line connecting a center of the photosensitive member and the charging wire at an acute angle. A plurality of spaced guide operative members in the form of a string are positioned over the opening and are spaced more closely in one area than in another area.

17 Claims, 8 Drawing Sheets

TONER IMAGE TRANSFER PROVIDED WITH A TRANSFER PAPER SEPARATING DEVICE AND GUIDE

BACKGROUND OF THE INVENTION

This invention relates to a toner image transfer provided with a transfer paper separating device which performs transferring a toner image from a photosensitive member of an image forming apparatus and separating the transfer paper bearing the toner image from the photosensitive member.

Generally, an image forming apparatus is operated as follows. A toner image is formed by a toner image forming unit including a photosensitive drum in the form of a drum, and is transferred onto transfer paper which is transported from a transfer paper storage portion to a surface of the photosensitive drum by a transfer. The transfer paper is separated from the photosensitive drum by a separating device, and the toner image is fixed on the transfer paper by a fixing device. Finally, the transfer paper is discharged from the apparatus.

FIG. 7 is a schematic diagram showing an arrangement of a photosensitive drum and its peripheral devices provided in a conventional image forming apparatus. FIG. 8 is a plan view of a left half portion of a transfer provided with a separating device in the arrangement when viewed from above or the photosensitive drum.

In this conventional image forming apparatus, a surface of the photosensitive drum 110 is charged positively at a specified level by a main charger 111, and a specified area of the photosensitive drum 110 is exposed to a light image reflected from an original document with light emitted from an exposure lamp 109 to form an electrostatic latent image. Subsequently, negatively charged toner particles are supplied from a developing charger 112 to the photosensitive drum 110, and electrically attracted to the positive latent image on the photosensitive drum surface to develop the latent image into a toner image. Thereafter, electric charges in an unnecessary area of the charged surface of the photosensitive drum 110 are removed by a blank lamp 113.

In synchronism with the developing process, transfer paper is guided through a transfer paper transport passage defined by transfer paper guide plates 106 and 107 by an unillustrated registration roller pair, and further transported near the surface of the photosensitive drum 110 while guided between transfer paper guide members 104 and 105 and by a pair of transport rollers 103 before a transferring operation. Upon being transported to the surface of the photosensitive drum 110, the transfer paper is applied with positive electric charges in a transferring portion 114 to transfer the toner image onto the transfer paper from the photosensitive drum 110. The transfer paper bearing the toner image is separated from the surface of the photosensitive drum 110 in a separating portion 115 which is driven by an alternating current, and guided to an unillustrated fixing unit through a transfer paper transport passage 127.

There is provided a toner image transfer 131 having a transfer paper separating device. Specifically, the toner image transfer 131 includes the transferring portion 114 provided with a charging wire 134, the separating portion 115 provided with a charging wire 135, and a shield casing 133. The transferring portion 114 and the separating portion 115 are formed integrally. The charging wires 134 and 135 have a very small diameter and are stretched between both side walls of the shield casing 133 in such a manner that the wires 134 and 135 are separated from each other by a partition wall 136 made of a metal and are insulated from the shield casing 133. The charging wire 134 is connected to an unillustrated high voltage power having a positive direct current, while the charging wire 135 is connected to an unillustrated high voltage power having an alternating current. The charging wires 134 and 135 respectively cause a corona discharge when being applied with a high voltage.

The shield casing 133 is made of metal and has an opening facing only the photosensitive drum 110 to direct the corona discharge of the charging wires 134 and 135 toward the photosensitive drum 110. As shown in FIG. 8, a string 137 made of nylon is wound around the shield casing 133. Indicated at 137*a*, 137*b*, . . . is a guide operative portion of the string 137 to prevent transfer paper being transported into a space between the photosensitive drum surface and the shield casing 133 from coming into the shield casing 133 through the opening while maintaining the corona discharge toward the photosensitive drum 110. The string 137 is wound in such a manner that the guide operative portions 137*a* and 137*b* are obliquely stretched apart at a specified interval and in parallel with each other.

In this conventional apparatus, the string 137 is wound around upper edges of the side walls 138 and 139 of the shield casing 133, i.e., stretched around the opening of the shield casing 133 in such a manner that the guide operative portions are substantially parallel with a tangent line at the point of the circumference of the photosensitive drum 110 which intersects a line connecting the center of the photosensitive drum 110 and the charging wire 134.

Further, rolled transfer paper has been used as transfer paper for image forming apparatus. A roll of transfer paper is cut according to needs. In this case, as shown in FIG. 7, a roll of transfer paper 108 is arranged in such a manner to permit a leading end portion of the roll paper to curl in a direction opposite to the curved surface of the photosensitive drum 110 when being transported along the photosensitive drum surface to prevent a likelihood that a sheet of transfer paper cut out from the roll of transfer paper 108 is curled up and entangled around the photosensitive drum 110.

However, since the sheet of transfer paper cut out from the roll of transfer paper curls in the direction away from the photosensitive drum 10, a leading end portion of the transfer paper sheet hardly advances along the curved surface of the photosensitive drum 110. Accordingly, it is difficult to transfer a toner image at the leading end portion of the transfer paper sheet which is away from the photosensitive drum surface.

Further, as shown in FIG. 9, when the leading end portion of the transfer paper sheet P passes over the opening of the toner image transfer 131, a corner of the leading end portion of the transfer paper sheet P is liable to come into the casing 133 through the space between adjacent guide operative portions of the string 137 because the leading end portion curls downward, and consequently hits against the side wall of the separating portion 115, which results in scattering of transferred toner particles from the transfer paper sheet and undesirable situations that scattering toner particles smear a surface of the transfer paper sheet being transported, the photosensitive drum 110 and its peripheral devices.

SUMMARY OF THE INVENTION

It is an object of the present invention to provide a toner image transfer provided with a transfer paper separating device which has overcome the problems residing in the prior art.

It is another object of the present invention to provide a toner image transfer provided with a transfer paper separating device which can reliably transfer a toner image onto a widened surface of transfer paper including a leading end portion of the transfer paper.

The present invention is directed to a toner image transfer for use in an image forming apparatus provided with a rotatable photosensitive member, the toner image transfer comprising: a transfer charging wire for transferring a toner image from the rotatable photosensitive member to transfer paper; a shield casing in the form of a box for shielding the transfer charging wire, the shield casing having a first wall extending in parallel with the transfer charging wire and a second wall extending in parallel with the first wall and positioned downstream of the first wall with respect to the rotation of the photosensitive member, the first and second walls respectively having free ends defining an opening facing the photosensitive member, the second wall having a height greater than the first wall.

The shield casing may be provided with a plurality of guide operative members in the form of a string over the opening. The guide operative members are divided into a first group positioned on one side of an intermediate plane perpendicularly intersecting an intermediate portion of the transfer charging wire and a second group positioned on the other side of the intermediate plane. The guide operative members in the first group and the guide operative members in the second group are symmetrically inclined with respect to the intermediate plane in such a manner that all the guide operative members run greater away from the intermediate plane as advancing in the downstream direction. Further, an interval on the free end of the second wall between a side end supporting guide operative member operable to support the side end of the transfer paper near the second wall and an inner adjacent guide operative member positioned inside of the transfer paper and adjacent to the side end supporting guide operative member is smaller than intervals on the free end of the second wall between the other guide operative members.

Also, it may be appreciated that at least the side end supporting guide operative member is inclined with respect to the intermediate plane intersecting the transfer charging wire in such a way that a distance between a first point where the side end edge of the transfer paper and the free end of the second wall intersect each other and a second point where the side end edge of the transfer paper and the side end supporting guide operative member intersect each other becomes smaller than a specified distance.

Further, it may be appreciated that at least the side end supporting guide operative member and the inner adjacent guide operative member are arranged in such a way that a distance between a first point where the side end edge of the transfer paper and the free end of the Second wall intersect each other and a second point where the inner adjacent guide operative member and the free end of the second wall intersect each other becomes smaller than a specified distance.

Furthermore, it may be appreciated that at least the side end supporting guide operative member and the inner adjacent guide operative member are arranged in such a way that a total of a first distance between a first point where the side end edge of the transfer paper and the free end of the second wall intersect each other and a second point where the side end edge of the transfer paper and the side end supporting guide operative member intersect each other and a second distance between the first point and a third point where the inner adjacent guide operative member and the free end of the second wall intersect each other becomes smaller than a specified distance.

The toner image transfer may be further provided with a separator charging wire on a downstream of the transfer charging wire, the separator charging wire being adapted for separating copy sheet from the photosensitive member.

Also, the present invention is directed to a toner image transfer for use in an image forming apparatus provided with a rotatable photosensitive member, the toner image transfer comprising: a transfer charging wire for transferring a toner image from the rotatable photosensitive member to transfer paper; a shield casing for shielding the transfer charging wire, the shield casing including a first wall extending in parallel with the transfer charging wire and a second wall extending in parallel with the first wall and positioned downstream of the first wall with respect to the rotation of the photosensitive member, the first and second walls respectively having free ends defining an opening facing the photosensitive member, an operative plane connecting the respective free ends of the first and second walls intersecting a reference plane connecting a center of the photosensitive member and the transfer charging wire in such a manner that the angle defined by the portion between the center of the photosensitive member and the intersection and the portion between the free end of the second wall and the intersection is an acute angle.

In thus constructed toner image transfer, the plane connecting the respective free ends of the first and second walls rises as progressing in the downstream direction. This construction will make a leading end of the transfer paper to come closer to the photosensitive member when transfer paper is transported between the photosensitive member and the toner image transfer. Accordingly, a toner image can be reliably transferred onto the transfer paper including the leading end.

The guide operative members are inclined with respect to a plane intersecting the charging wire, the interval between guide operative members in an area where a side end of transfer paper passes being made to be smaller than the interval between guide operative members in the other area. Accordingly, a corner of a leading end portion of the transfer paper can be reliably prevented from coming into the shield casing or hitting walls of the shield casing. Hence, a toner image having been transferred onto the transfer paper can be retained in a desirable state.

Further, a distance between a first intersecting point where the side end edge of the transfer paper and the free end of the second wall intersect each other and a second intersecting point where the side end edge of the transfer paper and the side end supporting guide operative member intersect each other is made to be smaller than a specified distance. Also, a distance between the first intersecting point and another intersecting point where the inner adjacent guide operative member and the free end of the second wall intersect each other is made to be smaller than a specified distance. Moreover, a total of a first intersecting distance between the first intersecting point and the second intersecting point and a second distance between the first intersecting point and the intersecting point where the inner adjacent guide operative member and the free end of the second wall intersect each other is made to be smaller than a specified distance. Accordingly, there can be prevented the likelihood that the leading corner portion of the transfer paper is abutted against the free end of the second wall. Thus, a toner image having been transferred onto the transfer paper can be retained in a desirable state.

The above and other objects, features and advantages of the present invention will become more apparent upon a reading of the following detailed description and drawings.

DETAILED DESCRIPTION OF THE PREFERRED EMBODIMENTS 0F THE INVENTION

Figure 1:
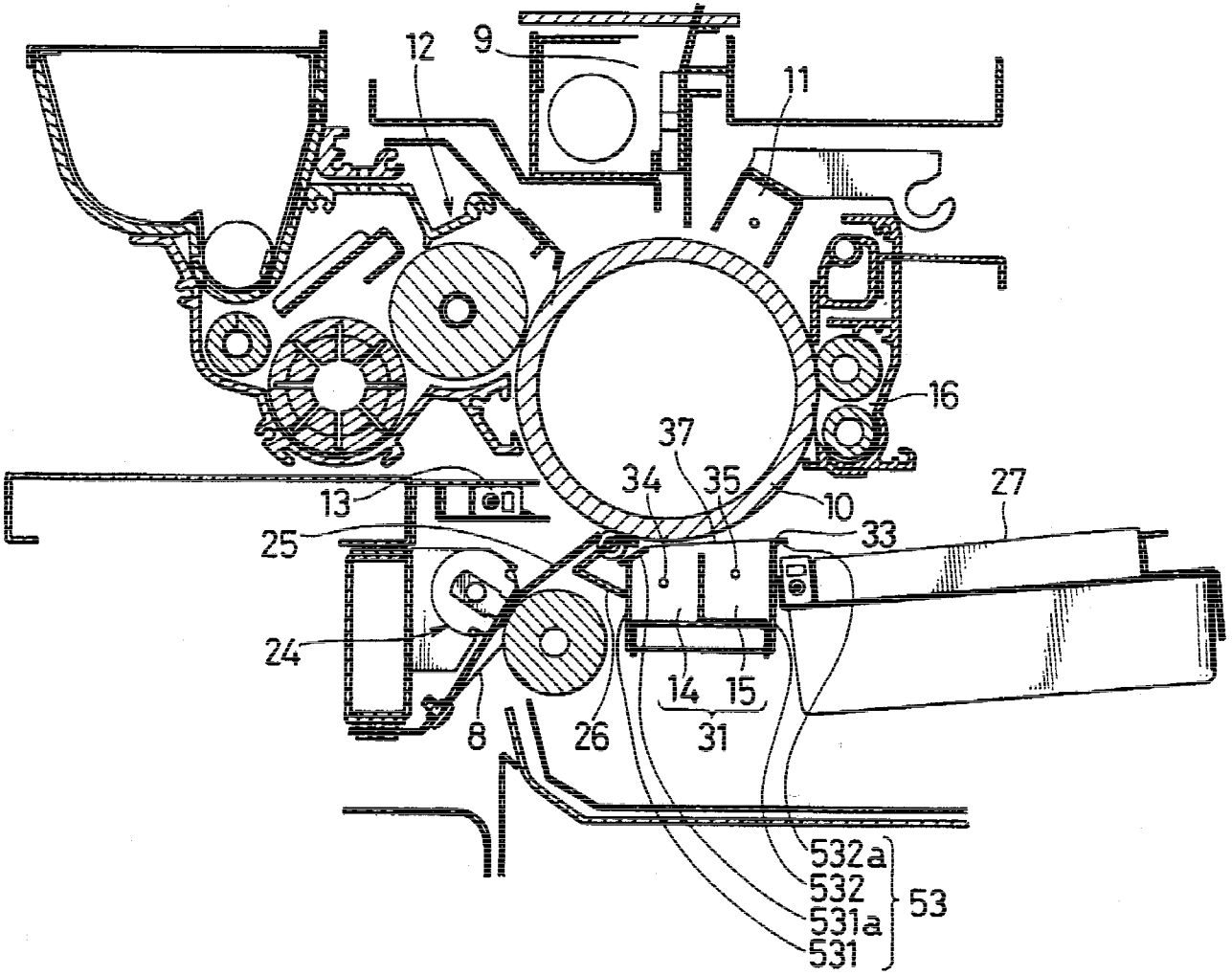
FIG. 1 is a diagram showing a construction of a main portion of an image forming apparatus including a toner image transfer provided with a transfer paper separating device embodying the present invention.
Figure 6:
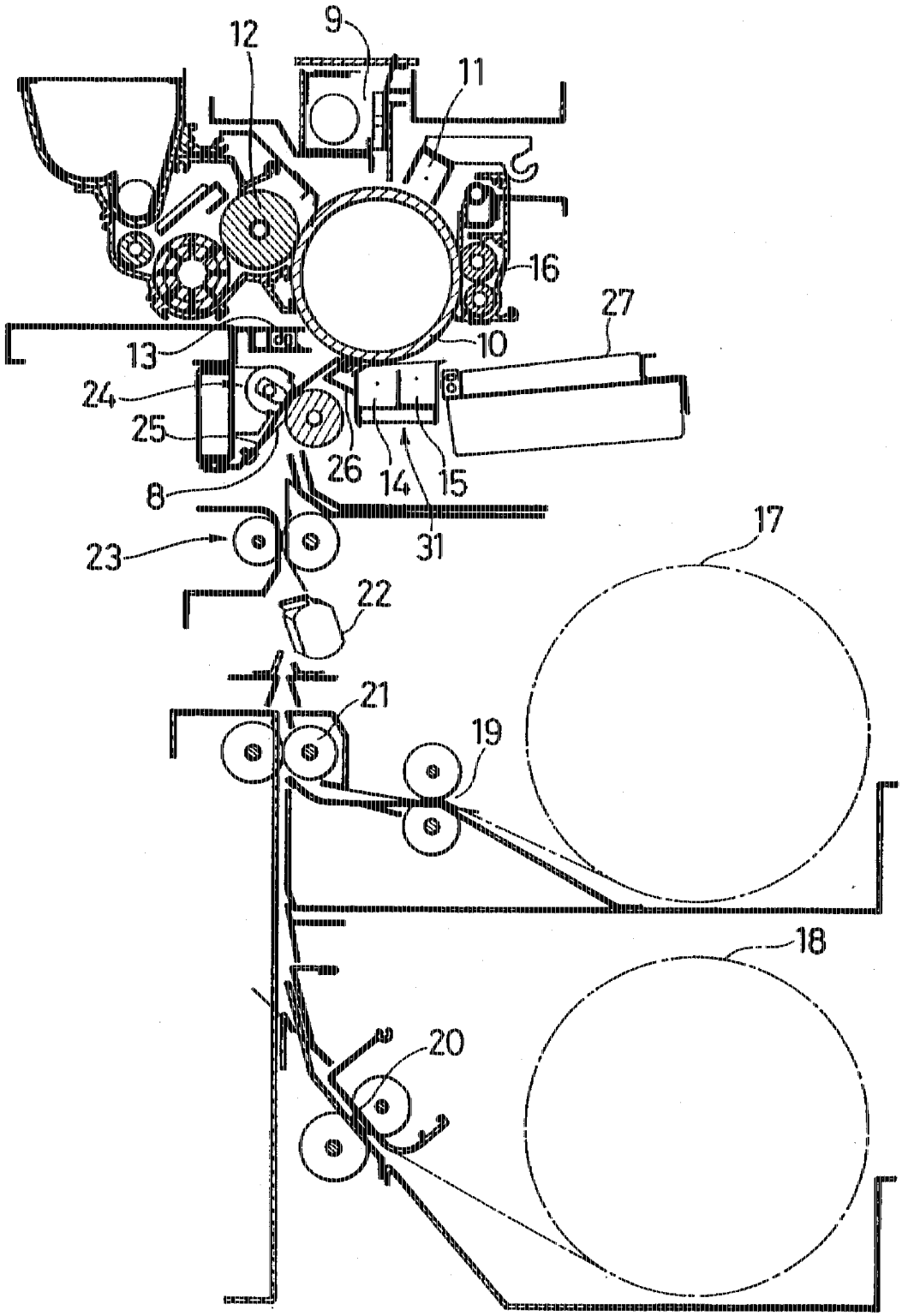
FIG. 6 is a diagram showing an arrangement of a transfer paper transport assembly, a photosensitive member and its peripheral devices.
Figure 7:
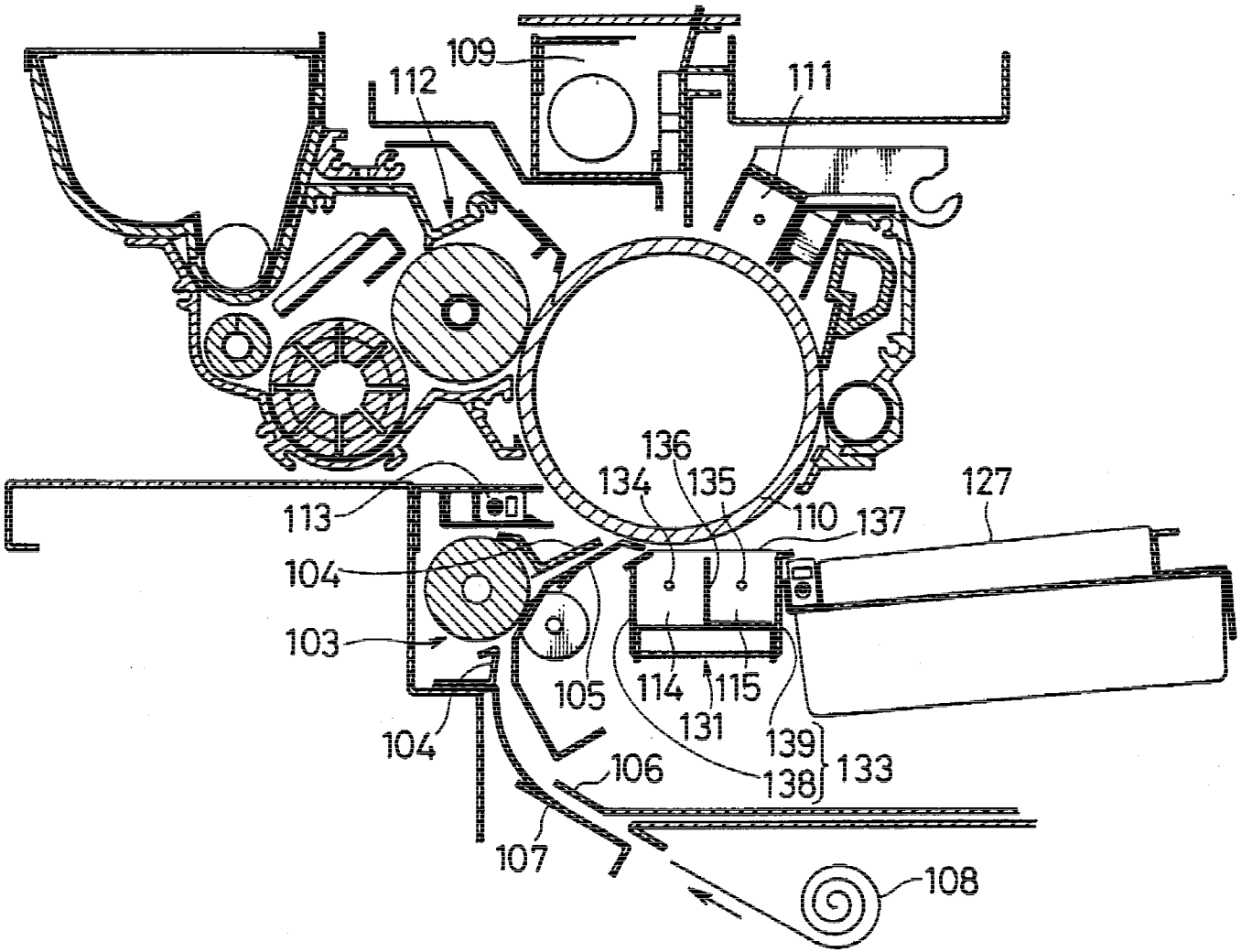
FIG. 7 PRIOR ART
FIG. 7 is a diagram showing a construction of a main portion of an image forming apparatus in prior art.
Figure 8:
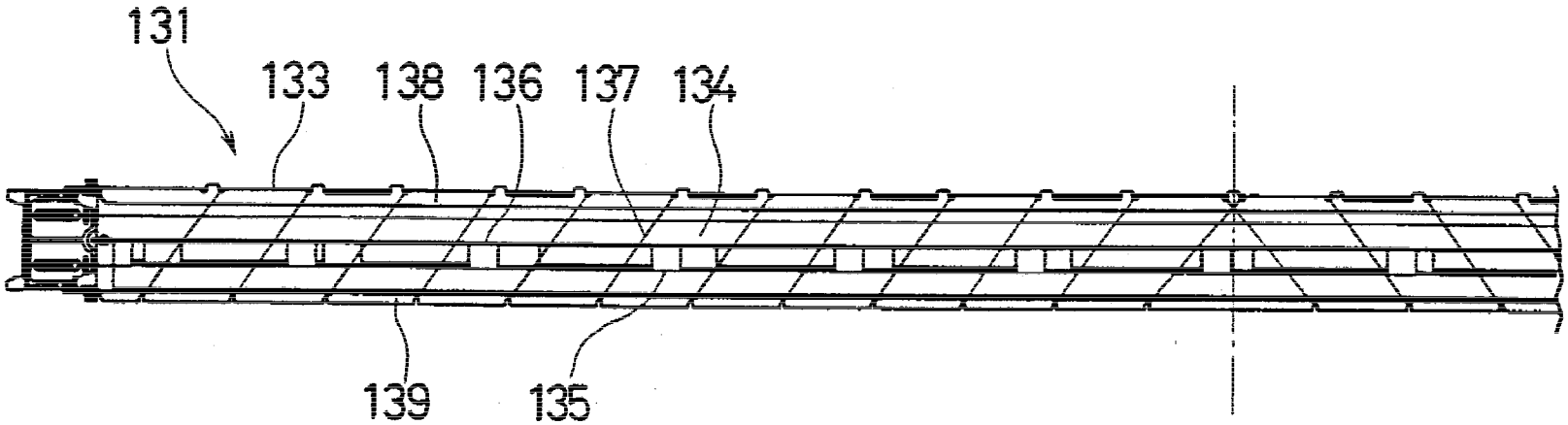
PRIOR ART FIG. 8
FIG. 8 is a plan view of a conventional toner image transfer when viewed from above.
Figure 9:
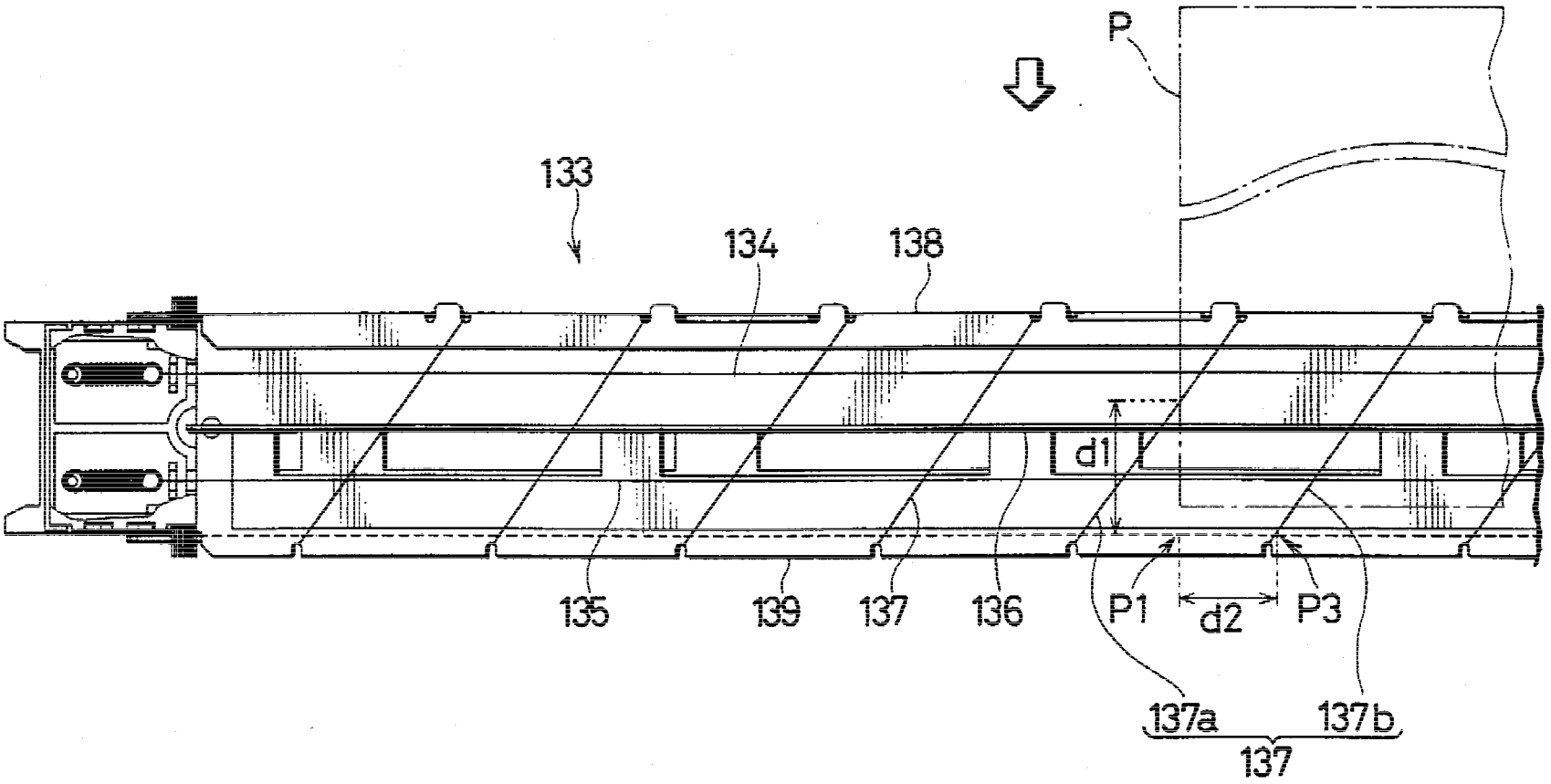
PRIOR ART FIG. 9
FIG. 9 is a partially enlarged view of the conventional toner image transfer.

An image forming apparatus incorporated with a toner image transfer in accordance with the present invention will be described with the accompanying drawings. FIG. 1 is a diagram showing a combination of a photosensitive member in the form of a drum and its peripheral devices. FIG. 6 is a schematic diagram showing a transfer paper transport assembly together with the photosensitive member and its peripheral devices. In addition to these parts, the image forming apparatus is internally provided with other various parts such as an imaging assembly.

The imaging assembly comprises a photosensitive drum 10 for forming an electrostatic latent image on a surface thereof, and various parts arranged in a specified position around a periphery of the photosensitive drum 10. Specifically, around the periphery of the photosensitive drum 10, arranged are a main charger 11 for positively charging the surface of the photosensitive drum 10 at a specified potential, an exposure lamp 9 for exposing a specified area on the surface of the photosensitive drum 10 to a light image reflected from an original document to form an electrostatic latent image, a developing charger 12 for charging toner particles negatively to electrically attract the charged toners to the electrostatic latent image to develop the latent image into a toner image, a blank lamp 13 for removing electric charges on an unnecessary area of the charged surface of the photosensitive drum 10; a toner image transfer 31, and a cleaner 16 for removing toner particles remaining on the surface of the photosensitive drum 10 after image transfer. The toner image transfer 31 includes a transferring portion 14 for transferring a toner image onto transfer paper and a separating portion 15 for separating the transfer paper bearing the toner image from the photosensitive drum 10. The transferring portion 14 and the separating portion 15 are integrally combined with each other to constitute the toner image transfer 31 capable of separating transfer paper.

The transfer paper transport assembly includes, from an upstream side with respect to a transfer paper transport direction, a transfer paper storage portion, pairs of feeding rollers 19 and 20, a pair of transport rollers 21, a cutter 22, a pair of registration rollers 23, a pair of transport rollers 24 before toner image transfer, and transport guide members 25 and 26 in this order.

The transfer paper storage portion includes a roll of transfer paper 17 having a large width capable of printing an image from a large-sized document such as A1-size with the larger side parallel with the transfer paper transport direction and A2-size with the smaller side parallel with the transfer paper transport direction and a roll of transfer paper 18 having an extra large width capable of printing an image from an extra large sized document such as A0 size with the larger side parallel with the transfer paper transport direction and A1 size with the smaller side parallel with the transfer paper transport direction.

The feeding roller pairs 19 and 20 feed the rolls of transfer paper 17 and 18 forward, respectively. The transport roller pair 21 transports the thus fed roll paper further forward. The cutter 22 cuts the roll paper being transported into a sheet having a specified size. The registration roller pair 23 transports the cut transfer paper downstream in synchronism with a developing process. The roller pair 24 transports the transfer paper further downstream to the photosensitive drum 10 just before toner image transfer through a transfer paper transport passage defined by the transport guide members 25 and 26. Further, at downstream of the photosensitive drum 10 after toner image transfer with respect to the transfer paper transport direction, arranged is a transfer paper transport guide 27 for guiding the transfer paper to an unillustrated fixing device. A film 8 arranged right upstream of the roller pair 24 is adapted to pressingly regulate the transfer paper against a surface of the roller 24 to prevent a warp or flexure of the transfer paper.

Next, a construction of the toner image transfer 31 including the transferring portion 14 and the separating portion 15 will be described with reference to FIGS. 1 to 5. The toner image transfer 31 is disposed right downstream of the photosensitive drum 10 from a position where transfer paper is to be guided to the photosensitive drum 10 with respect to the rotational direction of the photosensitive drum 10. The toner image transfer 31 includes charging wires 34 and 35 and a shield casing 33.

Figure 2:
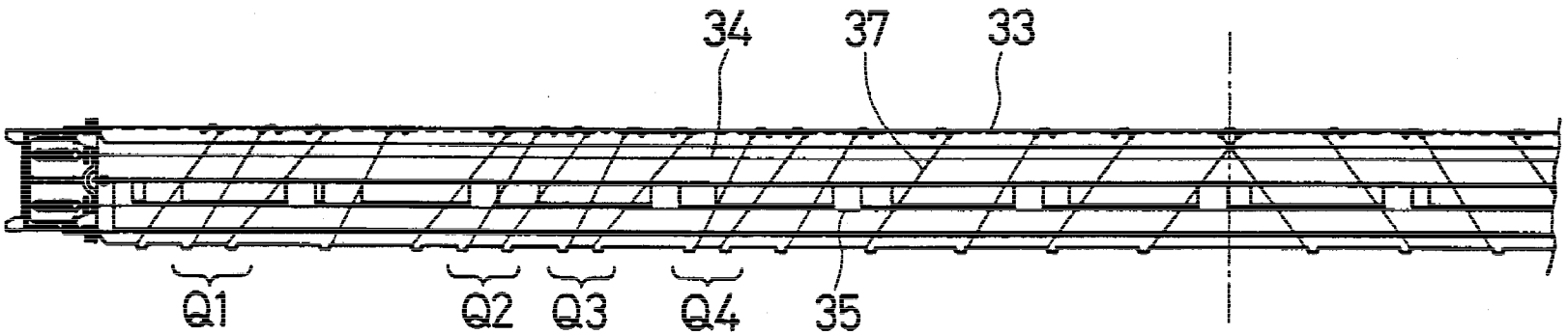
FIG. 2 is a plan view of the toner image transfer when viewed from the photosensitive member.
Figure 3A:
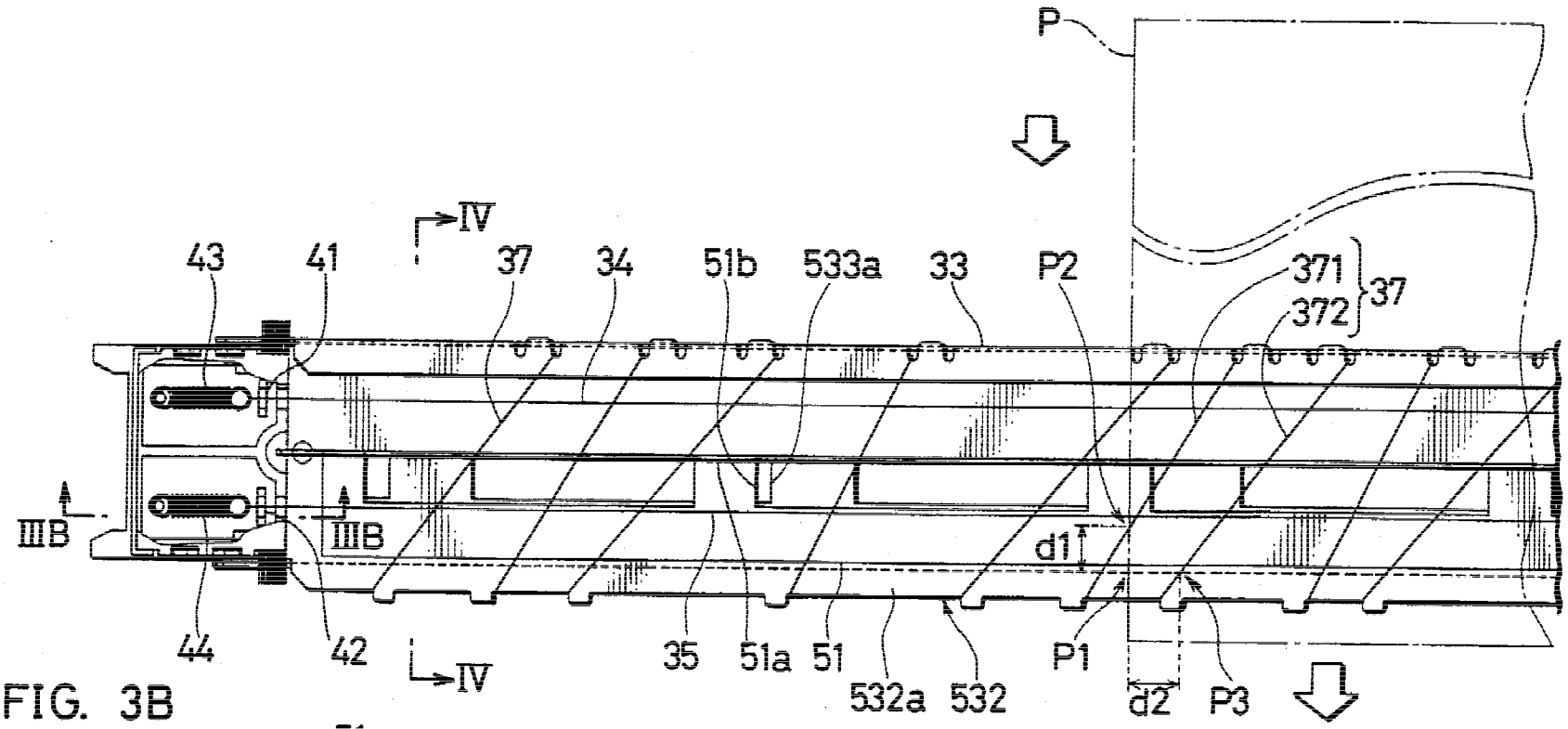
FIG. 3A is a partially enlarged view showing a part of the toner image transfer shown in FIG. 2.
Figure 3B:
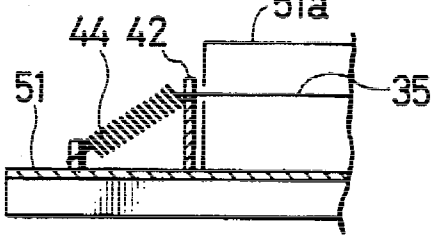
FIG. 3B is a sectional view taken along the line IIIB—IIIB in FIG. 3A.
Figure 4:
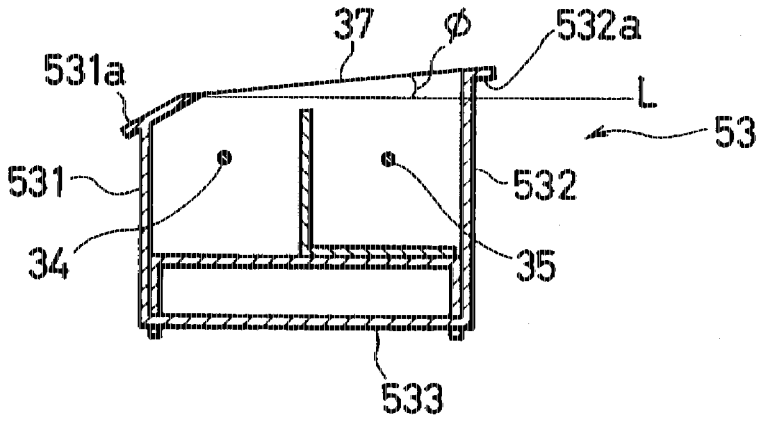
FIG. 4 is a sectional view taken along the line IV—IV in FIG. 3A.

FIG. 2 is a plan view of the toner image transfer 31 when viewed from the photosensitive drum 10. For sake of convenience of description, the figure only shows a left half portion of the toner image transfer 31 in a state that covers for covering mounting portions for mounting the charging wires 34 and 35 fragmentarily are broken away. FIG. 3A is a partially enlarged view of an end portion of the toner image transfer 31 in FIG. 2, and FIG. 3B is a sectional view taken along the line IIIB—IIIB in FIG. 3A, showing a tensioning manner of the charging wire 35. FIG. 4 is a sectional view taken along the line IV—IV in FIG. 3A.

The charging wires 34 and 35 having a very small diameter are formed of a tungsten, for example. As shown in FIGS. 3A and 3B, the wires 34 and 35 are tensionally secured to the shield casing 33 by fixedly connecting their respective one ends on a side wall of the shield casing 33 by screws and by connecting their respective other ends to springs 43 and 44. Tension plates 41 and 42 are provided immediately before the springs 43 and 44. The wires 34 and 35 are insulated from the shield casing 33 and stretched between the both ends of the shield casing 33 in parallel with each other with biasing force of the springs 43 and 44, respectively.

The charging wire 34 constitutes the transferring portion 14 by connecting the one end thereof to a high voltage power of positive direct current having several kilo voltage through distribution cable or banana plug. The charging wire 35 constitutes the separating portion 15 by connecting the other end thereof to a high voltage power of alternate current through distribution cable or banana plug. The charging wires 34 and 35 respectively cause corona discharge when being applied with a high voltage.

Figure 5A:
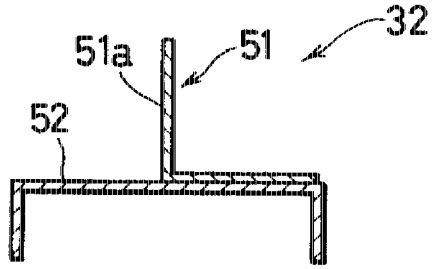
FIGS. 5A and 5B are sectional views respectively showing parts constituting a shield casing.
Figure 5B:
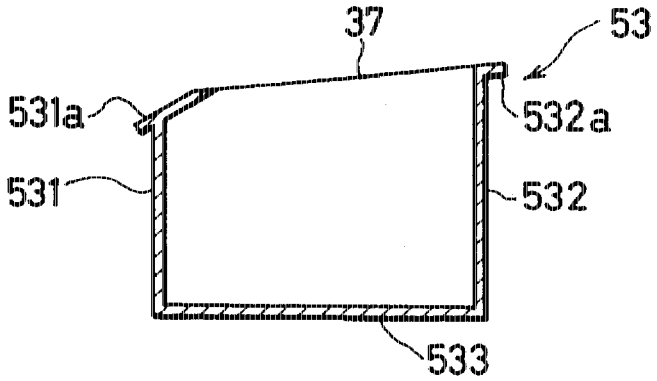

The shield casing 33 has an opening facing only the photosensitive drum 10 to direct the corona discharge of the charging wires 34 and 35 toward the photosensitive drum 10. The shield casing 33 is made of electrically conductive material, such as aluminum, iron, stainless steel and comprises a inner member 32 and an outer member 53 each having a specified shape as shown in FIGS. 5A and 5B.

The inner member 32 comprises an L-shaped channel 51 and an U-shaped channel 52 and is constructed by mounting the L-shaped channel 51 onto the inverted U-shaped channel 52 by spot welding. As mentioned above, the charging wires 34 and 35 are fixedly secured to the mounting portions which are provided at the side walls of the shield casing 33, i.e., both ends of an extending direction of the charging wires 34 and 35. The U-shaped channel 52 increases the bending and torsion strengths of the shield casing 33. The L-shaped channel 51 has a length smaller than the length of the U-shaped channel and is fitted between the mounting portions for the charging wires 34 and 35 formed at both ends of the U-shaped channel 52. A vertical portion 51*a* of the L-shaped channel 51 serves to separate the transferring portion 14 and the separating portion 15 from each other.

The outer member 53 has a box-like shape and is formed by a side wall 531 which defines the transferring portion 14 (disposed upstream with respect to the rotational direction of the photosensitive drum 10), a side wall 532 which defines the separating portion 15 (disposed downstream with respect to the rotational direction of the photosensitive drum 10), and a bottom wall 533. The side walls 531 and 532 are respectively formed with slopes 531*a* and 532*a* at an upper portion thereof. The slopes 531*a* and 532*a* are sloped upward in the rotational direction of the photosensitive drum 10. The slopes 531*a* and 532 are adapted for smoothly passing transfer paper being transported between the toner image transfer 31 and the surface of the photosensitive drum 10.

The side wall 532 has a height larger than the height of the side wall 531. The height of the side wall 532 is set in such a manner that an angle $\phi$ defined by a line L and a line connecting between an upper end of the slope 532*a* and an upper end of the slope 531*a* becomes 3.9 degree. The line L is a line parallel with the tangent line at the point of the circumferential surface of the photosensitive drum 10 which intersects a line connecting the center of the photosensitive drum 10 and the charging wire 34.

A string 37 is wound around the outer member 53. How the string 37 is wound around the outer member 53 of the shield casing 33 will be described later. The string 37 is made of, e.g., nylon and adapted for preventing transfer paper being transported over the opening of the shield casing 33 from coming into the shield casing 33 through the opening.

The inner member 32 is inserted into the outer member 53 from a side opening end of the outer member 53 to form a frame of the toner image transfer 31 shown in FIG. 4.

As shown in FIG. 3A, the bottom wall 533 of the outer member 53 is formed with a number of rectangular holes 533*a* having a specified length and width. Further, a bottom surface of the U-shaped channel 52 and L-shaped channel 51 is respectively formed with a number of rectangular holes 51*b*. The bottom surface of the U-shaped channel 52 and the L-shaped channel 51 are attached to each other by spot welding. The rectangular holes 51*b* and 533*a* are formed at a specified interval, and adapted for removing ozone which occurs around the charging wire 35 due to the corona discharge. Ozone has the specific gravity larger than the air. Accordingly, the formation of the holes in the bottom portion of the outer member 53 is advantageous in removing the ozone from the toner image transfer 31 where coroner discharge is caused.

The string 37 which is stretched around the opening of the shield casing 33 will be described with reference to FIG. 2 and FIG. 3A.

In FIG. 3A, let it be assumed that the string 37 has guide operative portions 371, 372, . . . , and a side end edge of transfer paper P passes over an inner end surface of the side wall 532 at the point P1; the side end edge of the transfer paper P is supported by the guide operative portion 371 at the point P2, i.e., a position nearest to the side wall 532; and the guide operative portion 372 next to and right inner side of the guide operative portion 371 is stretched over the inner end surface of the side wall 532 at the point P3. Further, let it be assumed that the distance between the points P1 and P2 is set at d1, while the distance between the points P1 and P3 is set at d2. In FIG. 3A, the point P2 is on the guide operative portion 371, and the point P3 is on the guide operative portion 372.

In this embodiment, an interval at which the guide operative portions of the string 37 are wound around the shield casing 33 is set at one of the following Equations (1) to (3) in areas Q1 to Q4 shown in FIG. 2:

$$d1 \leqq 10 \text{ mm} \quad (1)$$

$$d2 \leqq 10 \text{ mm} \quad (2)$$

$$d1+d2 \leqq 30 \text{ mm} \quad (3)$$

It should be noted that the value in the right side of the respective Equations is determined irrespective of the size of roll paper set in the transfer paper storage portion. The value is so small as to prevent a curled corner of the leading end portion of the transfer paper from coming into the shield casing 33. A side end edge of cut transfer paper sheet obtained by cutting the roll paper 18 passes in the area Q1, and a side end edge of another cut transfer paper sheet obtained by cutting the roll paper 17 passes in the area Q3.

The string 37 is stretched around the shield casing 33 at an interval larger than in the areas Q1 to Q4 in the area other than the areas Q1 to Q4 where a side end edge of transfer paper is not to pass, thereby ensuring the prevention of an leading end of the transfer paper from coming into the shield casing 33.

With the above construction, an image formation is executed as follows. A surface of the photosensitive drum 10 is charged positively at a specified level by the main charger 11, and a specified area of the photosensitive drum 10 is exposed to a light image reflected from an original document with a light emitted from the exposure lamp 9 to form an electrostatic latent image. Subsequently, negatively charged toner particles are supplied from the developing charger 12 to the photosensitive drum 10, and electrically attracted to the positive latent image on the photosensitive drum surface to develop the latent image into a toner image.

One of the roll of transfer paper 17 or 18 in the transfer paper storage portion is fed out by the feeding roller pair 19 or 20, transported forward by the transport roller pair 21, and cut by the cutter 22 to obtain a cut transfer paper of a specified size. Subsequently, the transfer paper is transported forward by the registration roller pair 23 as timed with the developing operation as mentioned above. After being pressed against one of the rollers 24 over its width by the film member 8, the transfer paper is nipped between the roller pair 24, and transported between the photosensitive drum 10 and the toner image transfer 31.

At this time, the transfer paper is transported in such a manner that a leading end of the transfer paper is brought into contact with the string 37 stretched around the opening of the outer member 53 of the toner image transfer 31 and slidingly guided along the stretched string 37. Since the inner end of the side wall 532 of the separating portion 15 is arranged near the photosensitive drum 10 than the inner end of the side wall 531 of the transferring portion 14 with respect to the line L which is parallel with the tangent line at the intersecting point of the circumferential surface of the photosensitive drum 10, the transfer paper is transported in a state that the leading end thereof comes closer to the photosensitive drum 10.

Further, the side end edges of the transported transfer paper passes in the area Q1 or Q3 where the string 37 is wound around the shield casing 33 at the relatively small interval set by the Equation (1), (2), or (3). Accordingly, the transfer paper is transported without the likelihood that the leading corner portion of the transfer paper comes into the shield casing 33 and hits against the side wall 532 of the outer member 53 because the side end edge of the transfer paper is reliably supported by the string 37.

The transported transfer paper is transferred with the toner image in the transferring portion 14 and is separated from the photosensitive drum 10 in the separating portion 15. The transfer paper bearing the toner image is transported downstream by the transfer paper transport guide 27 to the unillustrated fixing device where the toner image is fixed on the transfer paper.

The transfer paper is transported in the space between the photosensitive drum 10 and the toner image transfer 31 in the state that the leading end portion of the transfer paper comes closer to the photosensitive drum 10. Accordingly, the toner image can be clearly and reliably transferred even onto the leading end portion of the transfer paper. Further, the string 37 is wound around the shield casing 33 at the relatively small interval in the area where the side end edges of the transfer paper pass. Accordingly, the transfer paper can be transported in the state that the corner of the leading end portion of the transfer paper is reliably supported by the string 37. Thus, eliminated is the likelihood that the corner of the leading end portion hits against the side wall 532 of the outer member 53, which results in scattering of toner particles from the transfer paper.

In the foregoing embodiment, the string 37 is wound around the shield casing 33 at the small interval in the four areas Q1 to Q4 as shown in FIG. 2. Accordingly, four sizes of roll paper can be selected as a roll of transfer paper to be stored in the transfer paper storage portion.

Further, areas for reducing the interval at which the string 37 is wound around may be provided in accordance with the size of transfer paper to be set in the transfer paper storage portion. Thereby, the quantity of string 37 to be wound around the shield casing 33 can be suppressed at the minimum, and the time of winding the string 37 around the shield casing 33 can be reduced.

In the foregoing embodiment, the four areas Q1 to Q4 are provided for reducing the interval of winding the string 37. Alternatively, the string 37 is wound over the opening of the outer member 53 at a small interval over the entire length of the outer member 53. In this case, roll paper of an arbitrary size can be set in the transfer paper storage portion.

Further, the angle $\phi$ is not limited to 3.9 degree. In the case where the angle $\phi$ is to be increased, the numerical value in the right side of the Equations (1) to (3) may be decreased. On the contrary, in the case where the angle $\phi$ is to be decreased, the numerical value in the right side of the Equations (1) to (3) may be increased.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A toner image transfer for use in an image forming apparatus provided with a rotatable photosensitive member, the toner image transfer comprising:

a transfer charging wire for transferring a toner image from the rotatable photosensitive member to transfer paper;

a shield casing in the form of a box for shielding the transfer charging wire, the shield casing having a first wall extending in parallel with the transfer charging wire and a second wall extending in parallel with the first wall and positioned downstream of the first wall with respect to the rotation of the photosensitive member, the first and second walls respectively having free ends defining an opening facing the photosensitive member, the second wall having a height greater than the first wall;

a plurality of spaced guide operative members in the form of a string over the opening, the guide operative members including a first group positioned on one side of an intermediate plane perpendicularly intersecting an intermediate portion of the transfer charging wire and a second group positioned on the other side of the intermediate plane, said guide operative members in each of said first and second groups having a plurality of first areas and a plurality of second areas respectively, said guide operative members in each of said first plurality of areas being more closely spaced from one another than the spacing of said guides operative members in each said second areas.

2. A toner image transfer as defined in claim 1, wherein the guide operative members in the first group and the guide operative members in the second group are symmetrically inclined with respect to the intermediate plane in such a manner that all the guide operative members extend further away from the intermediate plane in advancing in the downstream direction.

3. A toner image transfer as defined in claim 2, wherein an interval on the free end of the second wall between a side end supporting guide operative member operable to support the side end of the transfer paper near the second wall and an inner adjacent guide operative member positioned inside of the transfer paper and adjacent to the side end supporting guide operative member is smaller than the intervals on the free end of the second wall between the other guide operative members, at least the side end supporting guide operative member is inclined with respect to the intermediate plane intersecting the transfer charging wire in such a way that a distance between a first point where the side end edge of the transfer paper and the free end of the second wall intersect each other and a second point where the side end edge of the transfer paper and the side end supporting guide operative member intersect each other does not exceed 10 mm.

4. A toner image transfer as defined in claim 2, wherein an interval on the free end of the second wall between a side end supporting guide operative member operable to support the side end of the transfer paper near the second wall and an inner adjacent guide operative member positioned inside of the transfer paper and adjacent to the side end supporting guide operative member is smaller than the intervals on the free end of the second wall between the other guide operative members, at least the side end supporting guide operative member and the inner adjacent guide operative member are arranged in such a way that a distance between a first point where the side end edge of the transfer paper and the free end of the second wall intersect each other and a second point where the inner adjacent guide operative member and the free end of the second wall intersect each other does not exceed 10 mm.

5. A toner image transfer as defined in claim 2, wherein an interval on the free end of the second wall between a side end supporting guide operative member operable to support the side end of the transfer paper near the second wall and an inner adjacent guide operative member positioned inside of the transfer paper and adjacent to the side end supporting guide operative member is smaller than the intervals on the free end of the second wall between the other guide operative members, at least the side end supporting guide operative member and the inner adjacent guide operative member are arranged in such a way that a total of:

a first distance between a first point where the side end edge of the transfer paper and the free end of the second wall intersect each other and a second point where the side end edge of the transfer paper and the side end supporting guide operative member intersect each other, and a second distance between the first point and a third point where the inner adjacent guide operative member and the free end of the second wall intersect each other;

does not exceed 30 mm.

6. A toner image transfer as defined in claim 1, further comprising a separator charging wire downstream of the transfer charging wire, the separator charging wire being adapted for separating copy sheet from the photosensitive member.

7. A toner image transfer for use in an image forming apparatus provided with a rotatable photosensitive member, the toner image transfer comprising:

a transfer charging wire for transferring a toner image from the rotatable photosensitive member to transfer paper;

a shield casing for shielding the transfer charging wire, the shield casing including a first wall extending in parallel with the transfer charging wire and a second wall extending in parallel with the first wall and positioned downstream of the first wall with respect to the rotation of the photosensitive member, the first and second walls respectively having free ends defining an opening facing the photosensitive member, an operative plane connecting the respective free ends of the first and second walls intersecting a first reference plane, said first reference plane being parallel to a second reference plane which is tangential to the circumference of the photosensitive member where a line extending between the center of the photosensitive member and the charging wire intersects the circumference of said photosensitive member, said operative plane intersecting said first reference plane at an acute angle, the shield casing being provided with a plurality of guide operative members over the opening, the guide operative members including a first group positioned on one side of an intermediate plane perpendicularly intersecting an intermediate portion of the transfer charging wire and a second group positioned on the other side of the intermediate plane;

an interval on the free end of the second wall between a side end supporting guide operative member operable to support the side end of the transfer paper near the second wall and an inner adjacent guide operative member positioned inside of the transfer paper and adjacent to the side end supporting guide operative member is smaller than the intervals on the free end of the second wall between the other guide operative members, at least the side end supporting guide operative member being inclined with respect to the plane intersecting the transfer charging wire in such a way that a distance between a first point where the side end edge of the transfer paper and the free end of the second wall intersect each other and a second point where the side end edge of the transfer paper and the side end supporting guide operative member intersect each other does not exceed 10 mm.

8. A toner image transfer as defined in claim 7, wherein the guide operative members in the first group and the guide operative members in the second group being symmetrically inclined with respect to the intermediate plane in such a manner that all the guide operative members extend further away from the intermediate plane in advancing in the downstream direction.

9. A toner image transfer as defined in claim 7, further comprising a separator charging wire downstream of the transfer charging wire, the separator charging wire being adapted for separating a copy sheet from the photosensitive member.

10. A toner image transfer for use in an image forming apparatus provided with a rotatable photosensitive member, the toner image transfer comprising:

a transfer charging wire for transferring a toner image from the rotatable photosensitive member to transfer paper;

a shield casing for shielding the transfer charging wire, the shield casing including a first wall extending in parallel with the transfer charging wire and a second wall extending in parallel with the first wall and positioned downstream of the first wall with respect to the rotation of the photosensitive member, the first and second walls respectively having free ends defining an opening facing the photosensitive member, an operative plane connecting the respective free ends of the first and second walls intersecting a first reference plane, said first reference plane being parallel to a second reference plane which is tangential to the circumference of the photosensitive member where a line extending between the center of the photosensitive member and the charging wire intersects the circumference of said photosensitive member, said operative plane intersecting said first reference plane at an acute angle, the shield casing being provided with a plurality of guide operative members over the opening, the guide operative members including a first group positioned on one side of an intermediate plane perpendicularly intersecting an intermediate portion of the transfer charging wire and a second group positioned on the other side of the intermediate plane, an interval on the free end of the second wall between a side end supporting guide operative member operable to support the side end of the transfer paper near the second wall and an inner adjacent guide operative member positioned inside of the transfer paper and adjacent to the side end supporting guide operative member is smaller than the intervals on the free end of the second wall between the other guide operative members, at least the side end supporting guide operative member and the inner adjacent guide operative member are arranged in such a way that a distance between a first point where the side end edge of the transfer paper and the free end of the second wall intersect each other and a second point where the inner adjacent guide operative member and the free end of the second wall intersect each other does not exceed 10 mm.

11. A toner image transfer for use in an image forming apparatus provided with a rotatable photosensitive member, the toner image transfer comprising:

a transfer charging wire for transferring a toner image from the rotatable photosensitive member to transfer paper;

a shield casing for shielding the transfer charging wire, the shield casing including a first wall extending in parallel with the transfer charging wire and a second wall extending in parallel with the first wall and positioned downstream of the first wall with respect to the rotation of the photosensitive member, the first and second walls respectively having free ends defining an opening facing the photosensitive member, an operative plane connecting the respective free ends of the first and second walls intersecting a first reference plane, said first reference plane being parallel to a second reference plane which is tangential to the circumference of the photosensitive member where a line extending between the center of the photosensitive member and the charging wire intersects the circumference of said photosensitive member, said operative plane intersecting said first reference plane at an acute angle, the shield casing being provided with a plurality of guide operative members over the opening, the guide operative members including a first group positioned on one side of an intermediate plane perpendicularly intersecting an intermediate portion of the transfer charging wire and a second group positioned on the other side of the intermediate plane, an interval on the free end of the second wall between a side end supporting guide operative member operable to support the side end of the transfer paper near the second wall and an inner adjacent guide operative member positioned inside of the transfer paper and adjacent to the side end supporting guide operative member is smaller than the intervals on the free end of the second wall between the other guide operative members, at least the side end supporting guide operative member and the inner adjacent guide operative member are arranged in such a way that a total of:

a first distance between a first point where the side end edge of the transfer paper and the free end of the second wall intersect each other and a second point wherein the side end edge of the transfer paper and the side end supporting guide operative member intersect each other, and a second distance between the first point and a third point where the inner adjacent guide operative member and the free end of the second wall intersect each other;

does not exceed 30 mm.

12. A toner image transfer apparatus for use in an image forming arrangement provided with a rotatable photosensitive member and wherein the toner image transfer apparatus is operable to transfer a toner image to transfer paper of different widths, the toner image transfer apparatus comprising:

a transfer charging wire for transferring a toner image from the rotatable photosensitive member to said transfer paper;

a shield casing for shielding the transfer charging wire, the shield casing having a first wall extending parallel with the transfer charging wire and a second wall extending parallel with the first wall and positioned downstream of the first wall with respect to the rotation of the photosensitive member, the first and second walls respectively having free ends defining an opening facing the photosensitive member;

a plurality of spaced guide operative members disposed over the opening, said guide operative members having a plurality of first areas and a plurality of second areas respectively, said guide operative members in each of said plurality of first areas being more closely spaced from one another than the spacing of said guide operative members in each of said second areas, said plurality of first areas being spaced from one another according to the width of the transfer sheet to which the toner image is transferred such that each of said guide operative members in said first areas are operable to guide said transfer paper as said transfer paper passes over said opening in said casing.

13. A toner image transfer as defined in claim 12 wherein said guide operative members in each of said first plurality of areas are non-parallel.

14. A toner image transfer as defined in claim 12 wherein there are two guide operative members in each of said first plurality of areas including an inner and an outer guide operative member intersecting said upper edge of said second wall at first and second points respectively, said inner and outer guide operative members intersecting said upper edge of said first wall at third and fourth points respectively, the distance between said first and second points being greater than the distance between said third and fourth points.

15. A toner image transfer as defined in claim 14 wherein each of said inner and outer guide operative members are operable to guide said transfer paper as said transfer paper passes over said opening in said casing.

16. A toner image transfer as defined in claim 12 wherein said guide operative members comprise a string.

17. A toner image transfer apparatus for use in an image forming arrangement provided with a rotatable photosensitive member and wherein the toner image transfer apparatus is operable to transfer a toner image to transfer paper, the toner image transfer apparatus comprising:

a transfer charging wire for transferring a toner image from the rotatable photosensitive member to said transfer paper;

a shield casing for shielding the transfer charging wire, the shield casing having a first wall extending parallel with the transfer charging wire and a second wall extending parallel with the first wall and positioned downstream of the first wall with respect to the rotation of the photosensitive member, the first and second walls respectively having free ends defining an opening facing the photosensitive member;

a plurality of spaced guide operative members disposed over the opening, said guide operative members having a plurality of first areas and a plurality of second areas respectively, said guide operative members in each of said plurality of first areas being non-parallel to one another, said guide operative members in each of said plurality of first areas being operable to guide said transfer paper as said transfer paper passes over said opening in said casing.

* * * * *